US005450100A

United States Patent [19]

Yamada et al.

[11] Patent Number: 5,450,100

[45] Date of Patent: Sep. 12, 1995

[54] THERMAL TRANSFER RECORDING METHOD AND APPARATUS FOR REDUCING INK SHEET AND RECORDING MEDIUM CONSUMPTION

[75] Inventors: Masakatsu Yamada; Minoru Yokoyama; Akihiro Tomoda, all of Yokohama; Yasushi Ishida, Tokyo; Takashi Awai, Yokohama; Satoshi Wada, Kawasaki; Takehiro Yoshida, Tokyo; Takeshi Ono, Yokohama; Makoto Kobayashi, Tama; Tomoyuki Takeda, Yokohama; Masaya Kondo, Tokyo; Takahiro Kato, Yokohama, all of Japan

[73] Assignee: Canon Kabushiki Kaisha, Tokyo, Japan

[21] Appl. No.: 180,776

[22] Filed: Jan. 10, 1994

Related U.S. Application Data

[63] Continuation of Ser. No. 622,750, Dec. 5, 1990, abandoned.

[30] Foreign Application Priority Data

Dec. 6, 1989 [JP] Japan ..... 1-315452

[51] Int. Cl.[6] ..... B41J 13/00; B41J 33/56

[52] U.S. Cl. ..... 347/215; 400/231; 400/706

[58] Field of Search ..... 346/76 PH, 1.1; 400/234, 232, 706, 231

[56] References Cited

U.S. PATENT DOCUMENTS

| | | | |
|---|---|---|---|
| 4,456,392 | 6/1984 | Nozaki et al. | 400/120 |
| 4,675,698 | 6/1987 | Tsutsumi | 346/76 PH |
| 4,709,242 | 11/1987 | Uchikata et al. | 346/76 PH |
| 4,712,931 | 12/1987 | Ohshima | 400/234 |
| 4,885,755 | 12/1989 | Yoshida | 375/58 |
| 4,894,843 | 1/1990 | Yoshida et al. | 375/8 |
| 4,924,240 | 5/1990 | Herbert et al. | 346/76 PH |

FOREIGN PATENT DOCUMENTS

| | | | |
|---|---|---|---|
| 57-83471 | 5/1982 | Japan . | |
| 58-7377 | 1/1983 | Japan . | |
| 58-201686 | 11/1983 | Japan . | |
| 59-95177 | 6/1984 | Japan | 346/76 PH |
| 61-41579 | 2/1986 | Japan . | |
| 0154965 | 7/1986 | Japan | 400/120 |
| 61-209183 | 9/1986 | Japan . | |
| 00-80075 | 4/1987 | Japan | 400/232 |
| 0298473 | 4/1990 | Japan | 346/76 PH |
| 2206574 | 8/1990 | Japan | 346/76 PH |
| 2175253 | 11/1986 | United Kingdom . | |

OTHER PUBLICATIONS

Eur. Pat. Off. Search Report for Eur. Pat. App. No. 90123456.7.

*Primary Examiner*—Benjamin R. Fuller
*Assistant Examiner*—N. Le
*Attorney, Agent, or Firm*—Fitzpatrick, Cella, Harper & Scinto

[57] ABSTRACT

A heat transfer recording method and apparatus for recording images onto a recording medium is realized by transferring ink contained in an ink sheet onto said recording medium. The apparatus comprises means for conveying the ink sheet in both the positive direction and the direction opposite to the positive direction, means for conveying the recording medium, and means for recording images onto the recording medium by acting on the ink sheet. The method is characterized in that a determination is made whether or not the length of images recorded onto the recording medium is less than or equal to that of the recording medium, and if so, the ink sheet is stopped and the recording medium is conveyed so that an end portion of said recording medium may be positioned at a recording position with the recording means.

14 Claims, 8 Drawing Sheets

THERMAL TRANSFER RECORDING METHOD AND APPARATUS FOR REDUCING INK SHEET AND RECORDING MEDIUM CONSUMPTION

This application is a continuation of application Ser. No. 07/622,750 filed Dec. 5, 1990 abandoned.

BACKGROUND OF THE INVENTION

The present invention relates to a thermal transfer recording method and apparatus for recording images onto a recording medium, by transferring ink contained in an ink sheet to the recording medium.

RELATED BACKGROUND ART

Generally, a thermal printer uses an ink sheet with heat-fusible (or heat-sublimable) ink applied to a base film, heats selected parts of the ink sheet with a thermal head in correspondence with an image signal, and records images by transferring fused (or sublimated) ink onto a recording sheet. As this ink sheet in general allows ink to be transferred entirely onto the recording sheet with one time of image recording (so called one-time sheet), after one character or line had been recorded, it is required to convey the ink sheet by an amount corresponding to the recorded length and then to bring an unused part of the ink sheet to the next recording position. Therefore, the usage of ink sheet increases, so that the running cost for the thermal transfer printer tended to be higher than that for a conventional thermal printer for recording onto a thermosensible paper.

To resolve the above problem, a thermal transfer printer has been proposed in which a recording sheet and an ink sheet are conveyed with some difference of speeds, as described in official gazettes for Japanese Laid-Open Patent Application No. 57-83471 and No. 58-201686, or Japanese Patent Publication No. 62-58917.

This invention has further developed those described in the above mentioned publications.

As described in the publications as shown above, an ink sheet which enables the multiple times (n) of recordings of image is known (so called a multi-print sheet), with which it is possible to record a recording sheet of length L continuously, by making the length of conveying the ink sheet after or during image recording being less than that length L ($L/n:n>1$). This relation is expressed as $V_I=V_P/n$, where $V_P$ is the speed of conveying the recording sheet, and $V_I$ is that of conveying the ink sheet. Thereby, the efficiency of use for the ink sheet can be increased to n times as much as that for a conventional one, which will lead to the decrease of the running cost for the thermal transfer printer. Thereafter such a recording method is known as the multi-print.

In such a print method, when a cut sheet was used as a recording sheet, and the length of image recorded in the subscanning direction was shorter than that of the cut sheet in the sub-scanning direction, the ink and recording sheets were conveyed simultaneously in the same direction to discharge the recorded sheet after image data of the page were all recorded. As the recording can not be performed while the recorded sheet is being conveyed for exhausting, the amount of the ink sheet to be conveyed along with it becomes wasteful. To eliminate this waste, it is conceivable to rewind the ink sheet to a position where the recording has been terminated, but there is then a problem that the time of rewinding ink sheet is wasteful.

SUMMARY OF THE INVENTION

Accordingly, it is an object of this invention to provide a thermal transfer recording method and apparatus which makes it possible to significantly decrease the amount of ink sheet that it wastefully conveyed without contributing to the recording.

It is another object of this invention to provide a thermal transfer recording method and apparatus which can shorten the recording time.

It is another object of this invention to provide a thermal transfer recording method and apparatus which allows an excellent recording, even when using a cut sheet as a recording medium.

It is another object of this invention to provide a thermal transfer recording method and apparatus which can record in a shorter time and eliminate the waste of ink sheet, such that if the recording length of image data recorded onto a recording medium in the sub-scanning direction is shorter than that of the recording medium in the sub-scanning direction, the ink sheet is stopped and the recording medium is conveyed in the discharge direction, when the recorded sheet is discharged after recording.

It is another object of this invention to provide a thermal transfer recording method and apparatus which can shorten the recording time, by conveying a recording medium at a higher speed at the discharge than during recording.

It is another object of this invention to provide a thermal transfer recording method and apparatus in which a determination is made whether or not the length of image recorded onto a recording medium is less than or equal to the effective image recording length of recording medium, and if so, the ink sheet is stopped and an end portion of the recording medium is conveyed to the recording position.

It is still another object of this invention to provide a thermal transfer recording method and apparatus which can convey said recorded medium at a higher speed for discharge than at the ordinary recording.

DETAILED DESCRIPTION OF THE PREFERRED EMBODIMENTS

In the following, a preferred embodiment of this invention will be described in more detail with reference to the accompanying drawings.

Figure 1:
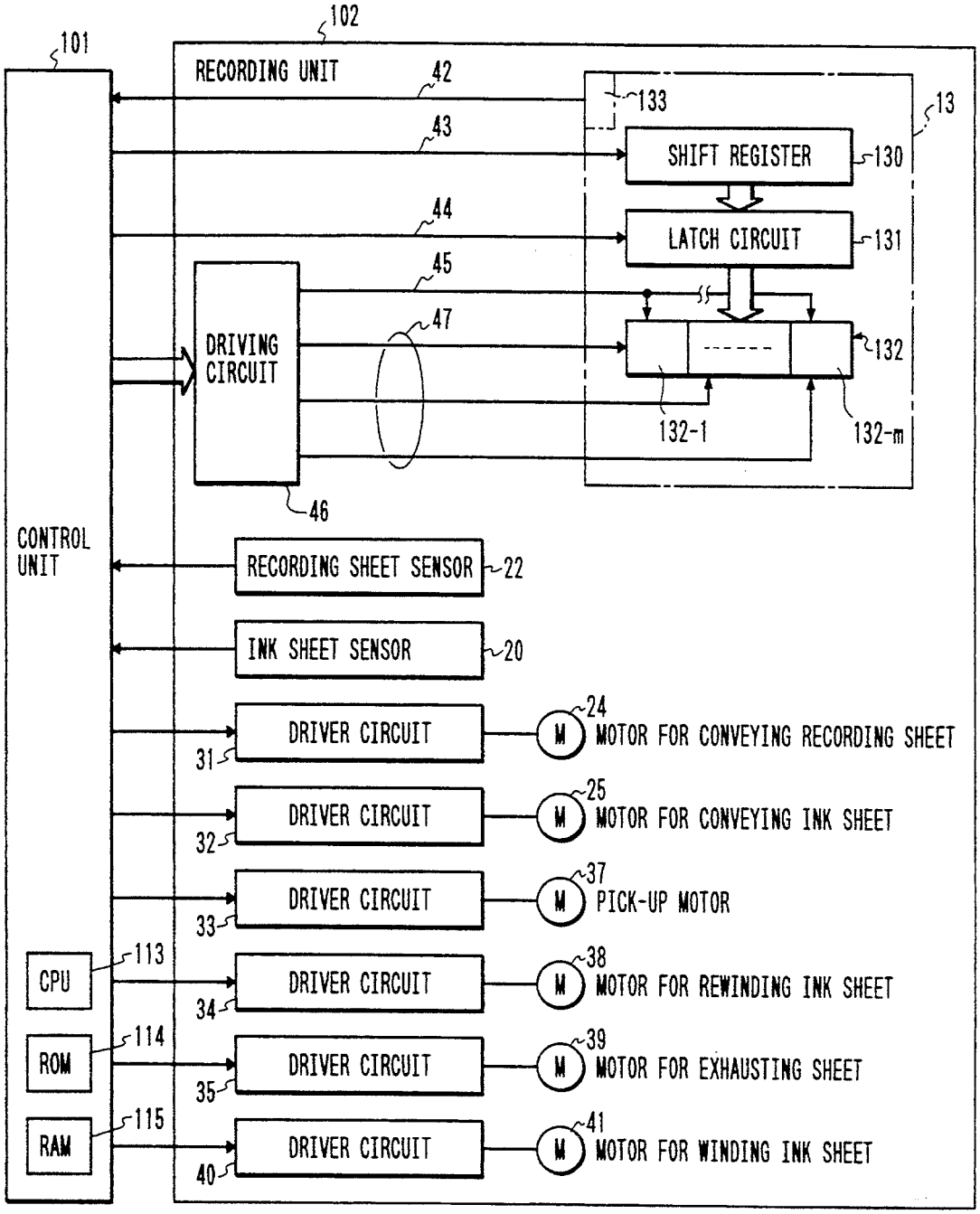
FIG. 1 is a view of electrical connections between control and recording units in a facsimile terminal equipment of this invention.
Figure 2:
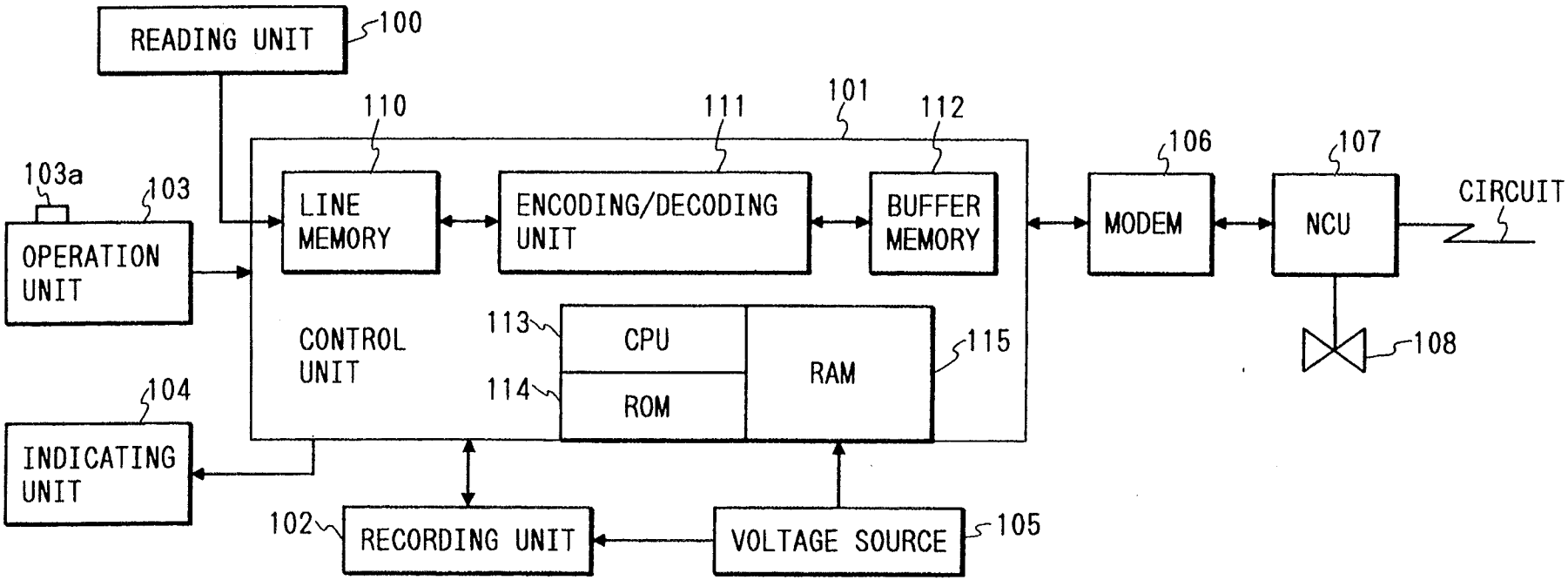
FIG. 2 is a schematic block diagram showing a physical configuration for the facsimile terminal equipment of this invention.
Figure 3:
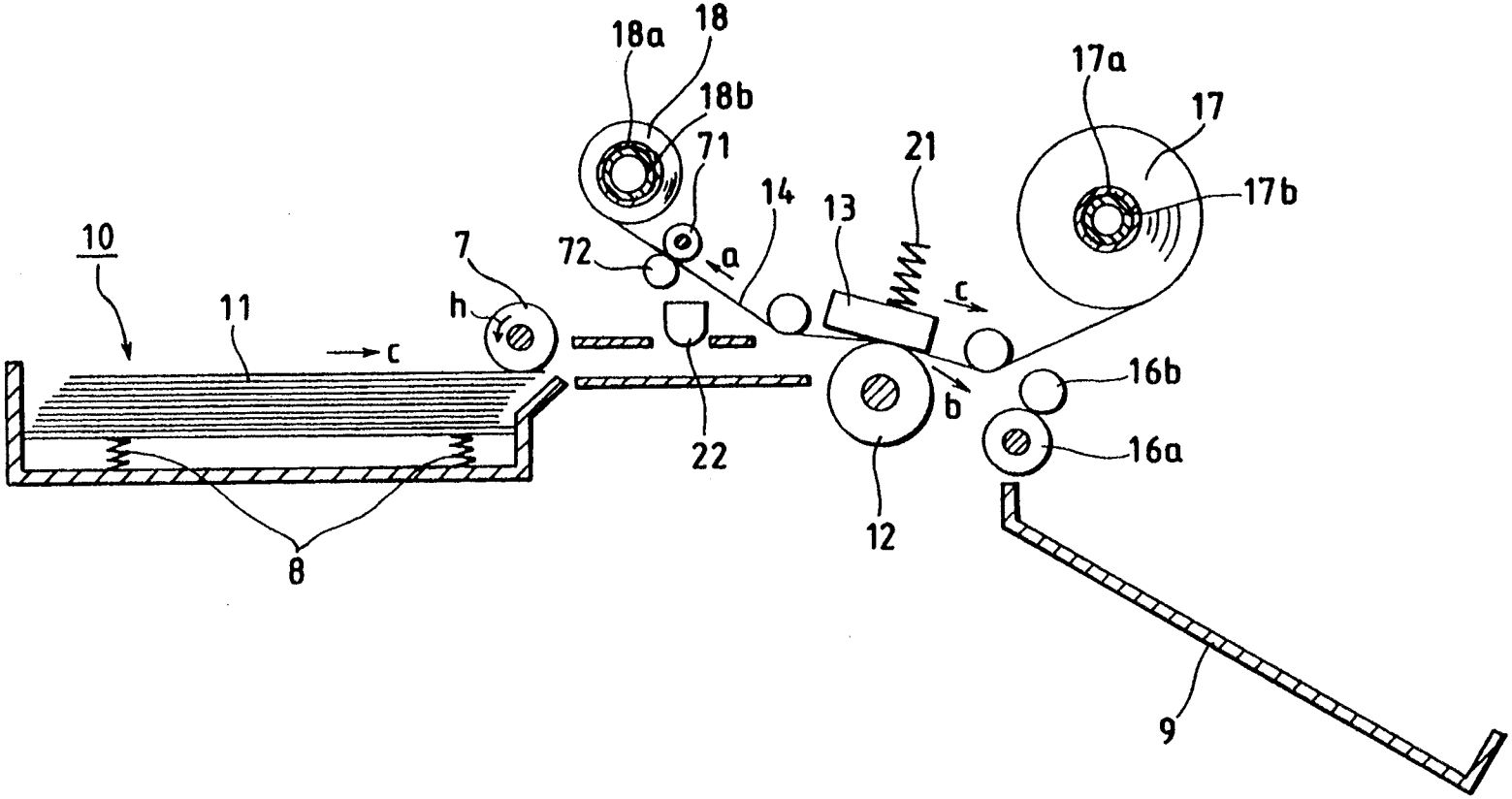
FIG. 3 is a view showing the construction of a recording unit in the facsimile terminal equipment of this invention.

Explanation of facsimile terminal equipment (FIGS. 1–3)

FIGS. 1–3 show an example of a facsimile terminal equipment with a thermal transfer printer in accordance with one embodiment of this invention. FIG. 1 is a view of electrical connections between a control unit 101 and a recording unit 102 in the facsimile terminal equipment, FIG. 2 is a schematic block diagram showing a physical configuration of the facsimile terminal equipment, and FIG. 3 is a cross-sectional side view showing the construction of the recording unit in the facsimile terminal equipment of this invention.

Referring now to FIG. 2 showing a schematic block diagram of the facsimile terminal equipment, 100 is a reading unit for reading an original sheet photoelectrically and outputting it to a control unit 101 as a digital image signal, and is provided with a motor for conveying an original sheet and a CCD image sensor. Now referring particularly to the construction of the control unit 101, 110 is a line memory for storing each line of image data, in which one line of image data from the reading unit 100 is stored for the transmission or copy of the original sheet, or one line of decoded image data is stored for the reception of image data. The stored image data is output to a recording unit 102, and that image is formed onto a recording medium such as a recording sheet. 111 is an encoding/decoding unit for encoding image data to be transmitted with an encoding method such as MH encoding, as well as decoding encoded image data that are received into image data. 112 is a buffer memory for storing encoded image data that will be transmitted or were received. Each of these portions in the control unit 101 is controlled by the CPU 113 such as a microprocessor. The control unit 101 is provided with a ROM 114 for storing control programs for the CPU 113 or various data, and a RAM 115 for temporarily storing various data as a work area for the CPU 113, in addition to the CPU 113.

102 is a recording unit for recording images onto a recording sheet with the thermal transfer recording method, and is provided with a thermal line head having a plurality of heating resistive elements 132 over the recording area. This construction will be described later in more detail with reference to FIG. 1 and FIG. 3. 103 is an operation unit which contains various keys for indicating functions such as a start of transmission, or input keys for telephone numbers. **103*a* is a switch operated by an operator for indicating a type of ink sheet 14 to be used, i.e., indicating that an ink sheet for multiprint is loaded if the switch 103*a* is on, and that an ordinary ink sheet 14 is loaded if it is off. 104, normally provided at the operation unit 103, is an indicating unit for indicating various functions and statuses of apparatus. 105 is a voltage source unit for supplying power to the entire apparatus. And 106 is a modem (modulator/demodulator), 107 is a network control unit (NCU), and 108** is a telephone.

Now referring to FIG. 3, the construction of the recording unit 102 for conveying a recording sheet and an ink sheet, as well as recording thereon, will be described below in more detail.

In the drawing, 10 is a recording sheet cassette for containing a plurality of stacked recording media 11 which are plain paper (or cut sheets). Recording sheet 11 stacked in this recording sheet cassette 10, is separated into a single sheet by rotation of a pickup roller 7, is conveyed in the direction toward a thermal head 13. The pickup roller 7 is driven and rotated by a pickup motor 37 (FIG. 1). 12 is a platen roller for conveying a recording sheet 11 in the direction as indicated by arrow b, as well as serving to press an ink sheet 14 and a recording sheet 11 against the heating resistive elements 132 (FIG. 1) of the thermal head 13. The recording sheet 11 having images recorded by heating of the thermal head 13 is conveyed in the direction toward discharge rollers **16*a*, 16*b* by further rotations of the platen roller 12. And the recording sheet 11 having images recorded is discharged from the apparatus, by the discharge rollers 16*a*, 16*b* rotating in the direction as indicated by arrow. The platen roller 12 is driven and rotated by a motor for conveying recording sheet 24**.

An ink sheet 14 is conveyed in the direction as indicated by arrow a, carried between two capstan rollers 71, 72, where the capstan roller 71 is driven and rotated by a motor 25 for conveying ink sheet (FIG. 1). Thus at the recording with the thermal transfer method, the ink sheet 14 is conveyed in the direction as indicated by arrow a, by rotation of the capstan roller 71 and the pinch roller 72, and is wound onto a take-up roll 18. The take-up roll 18 is driven and rotated by a motor 41 for winding the ink sheet (FIG. 1).

With this configuration, it is possible to wind the ink sheet 14 conveyed in the direction as indicated by arrow a by rotations of the capstan roller 71 and the pinch roller 72 onto the take-up roll 18, in which the amount of winding with the take-up roller 18 is set to be a little greater than that of conveying the ink sheet 14 with the capstan roller 71 and the pinch roller 72, and the difference between them in winding is absorbed by a sliding clutch **18*a*. Thereby any wrinkle or slack of the ink sheet 14 between the capstan roller 71 and the take-up roll 18** is prevented.

17 is an ink sheet supply roll having ink sheet 14 wound thereon, in which a sliding clutch **17*b* is attached at the rotation axis 17*a* of the supply roll 17. A gear 17*a* of the sliding clutch 17*b* is mated with a gear (not shown) provided at the rotation axis (not shown) of a motor 38 (FIG. 1) for rewinding the ink sheet with rotation of the ink sheet supply roll 17. Thereby when the ink sheet 14 is conveyed in the direction as indicated by arrow a, the supply roll 17 supplies the ink sheet 14 in the direction as indicated by arrow a, by freely rotating clockwise with action of the sliding clutch 17*b*. On the other hand, when rewinding the ink sheet 14 in the direction opposite to the arrow a direction, the ink sheet supply roll 17 is driven and rotated counterclockwise with rotation of the rewinding motor 38. In other words, when rewinding the ink sheet 14, the ink sheet supply roll 17 can rewind the ink sheet 14 in the direction as indicated by arrow c, because the take-up roll 18** is freely rotated counter-clockwise.

13 is a thermal line head having one line of heating resistive elements 132 in the direction orthogonal to the direction of conveying the recording sheet 11. 14 is a multi ink sheet for enabling a plurality of recordings. 21 is a spring which serves to press the thermal head 13 against the platen roller via the recording sheet 11 and the ink sheet 14. And 22 is a recording sheet sensor for detecting the leading and trailing edges of the recording sheet (cut sheet), as well as detecting whether the recording sheet 11 exists or not.

FIG. 1 is a view showing the electrical connections between the control unit 101 and the recording unit 102 in the facsimile terminal equipment of this invention, wherein like reference numbers designate like parts throughout the drawings.

The thermal head 13 is a line head, and is provided with a shift register 130 for inputting one line of serial recording data 43 from the control unit 101, a latch circuit 131 for latching data in the shift register 130 depending on a latch signal 44, and the heating elements 132 consisting of one line of heating resistive elements, in which the heating resistive elements 132 are divided into m blocks 132-1 to 132-m.

133 is a thermal sensor for detecting the temperature of thermal head 13, and is attached to the thermal head 13. Output signal 42 from the thermal sensor 133 is transmitted to the CPU 113 after being converted from analog to digital form within the control unit 101. Thereby the CPU 113 can detect the temperature of thermal head 13, and with reference to that temperature, can change the amount of energy applied to the thermal head 13 in accordance with the characteristic of ink sheet 14, by altering the pulse width of strobe signal 47 output from a driving circuit 46, or altering a driving voltage for the thermal head 13. The characteristic (type) of the ink sheet 14 is indicated by a switch 103*a* on the operation unit 103 as described before.

It should be noted that the type or characteristic of an ink sheet 14 can be determined by a mark printed on the ink sheet 14, or a mark or cut-out attached to a cassette or cartridge for the ink sheet.

46 is a driving circuit for inputting a drive signal for the thermal head 13 from the control unit 101, and outputting a strobe signal 47 for driving the thermal head 13 for each block. It should be noted that this driving circuit 46 can change the amount of energy applied to the thermal head 13, by changing the period of output time applied by the voltage source line 45 for supplying current to the heating elements 132 within the thermal head 13, with an indication from the control unit 101. 22 is a recording sheet sensor as described previously, and 20 is an ink sheet sensor for detecting whether or not the ink sheet 14 exists, or the speed of conveying the ink sheet 14. 31, 32 and 40 are driver circuits for driving and rotating a motor 24 for conveying recording sheet, a motor 25 for conveying ink sheet and a motor 41 for winding ink sheet, respectively. And 33, 34, and 35 are driver circuits for driving and rotating a pickup motor 37, a motor 38 for rewinding ink sheet, and a motor 39 for discharging the recorded sheet, respectively. It should be noted that each motor used in this embodiment is a stepping motor, but is not limited to such, and a DC motor, for example, can be used.

Referring now to a flowchart of FIG. 4 and operation views of FIG. 5 for conveying a recording sheet and an ink sheet, the operation of a facsimile terminal equipment according to one embodiment of this invention as shown above will be described. In FIG. 5, slashed portions of the ink sheet 14 indicate unused parts thereof, while unslashed portions indicate used parts.

Figure 4:
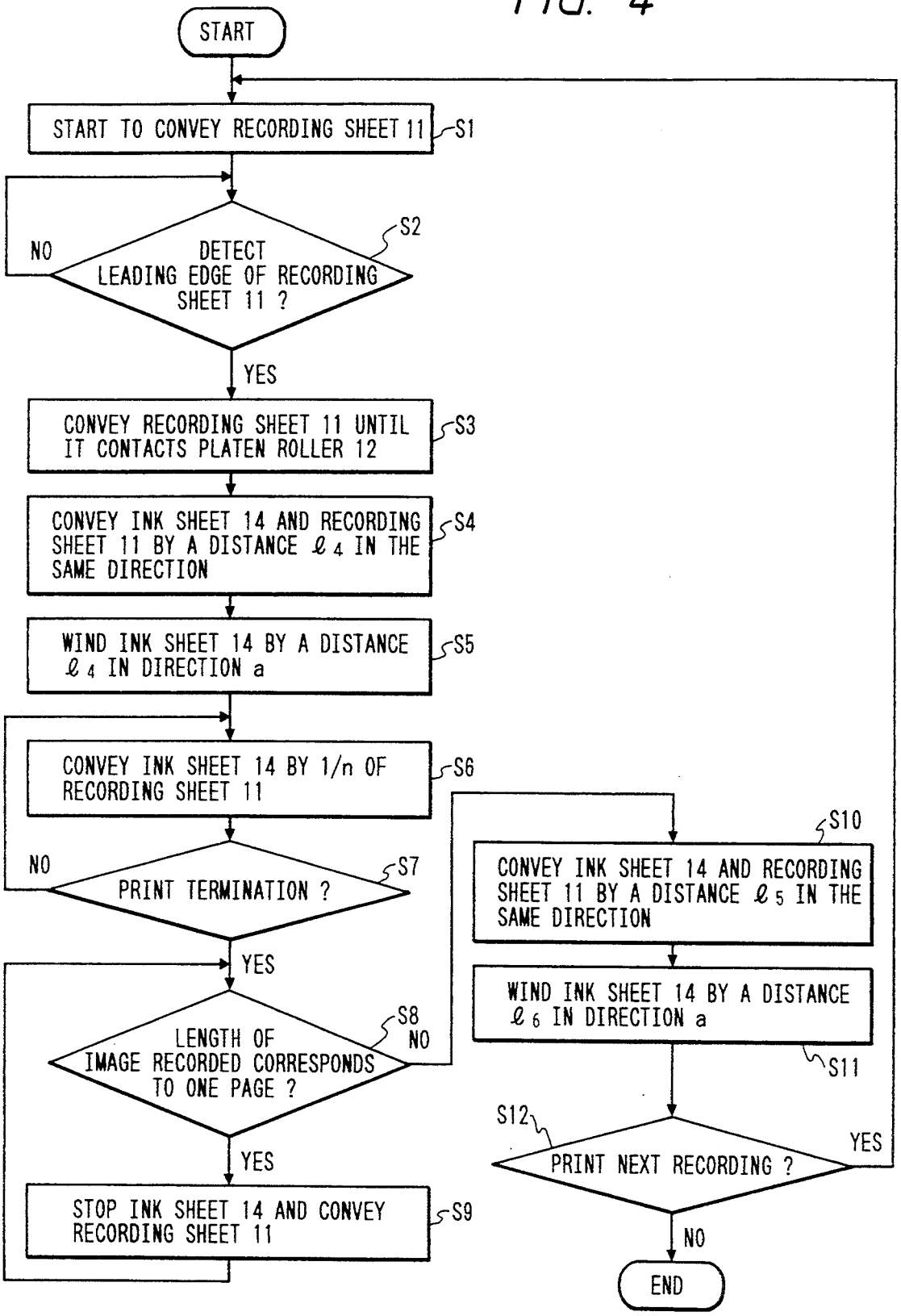
FIG. 4 is a flowchart showing the processing for conveying a recording sheet and an ink sheet in the facsimile terminal equipment of this invention, FIGS. 5A(I)–5A(III) to 5F are views for illustrating the movements of a recording sheet and an ink sheet according to this invention.

Explanation of operation (FIG. 1, FIG. 4, FIG. 5)

FIG. 4 is a flowchart showing the processing of recording one page in a facsimile terminal equipment according to this invention. A control program for performing this processing is stored in the ROM 114 within the control unit 101.

This processing starts at the time when one line of image data to be recorded is stored in a line memory 110 of the control unit 101, and thus the recording operation is made ready. FIG. 5 is a view showing the states of a recording sheet 11 and an ink sheet 14 in conveying the recording sheet 11 and the ink sheet 14 as shown in the flowchart of FIG. 4. With reference to the flowchart of FIG. 4 and the drawings of FIG. 5, the operation will be described in more detail below.

First, at step S1, the pickup roller 7 is started to rotate by the pickup motor 37, so that a recording sheet 11 is started to convey. And at step S2, the recording sheet 11 is conveyed until a leading edge of the recording sheet 11 is detected by the recording sheet sensor 22. If the leading edge of the recording sheet 11 is detected by the recording sheet sensor 22, the operation proceeds to step S3 where the recording sheet 11 is further conveyed in the direction as indicated by arrow c. And the oblique orientation of recording sheet 11 is corrected when the leading edge of the recording sheet 11 pressed against the platen roller 12.

Figure 5A:
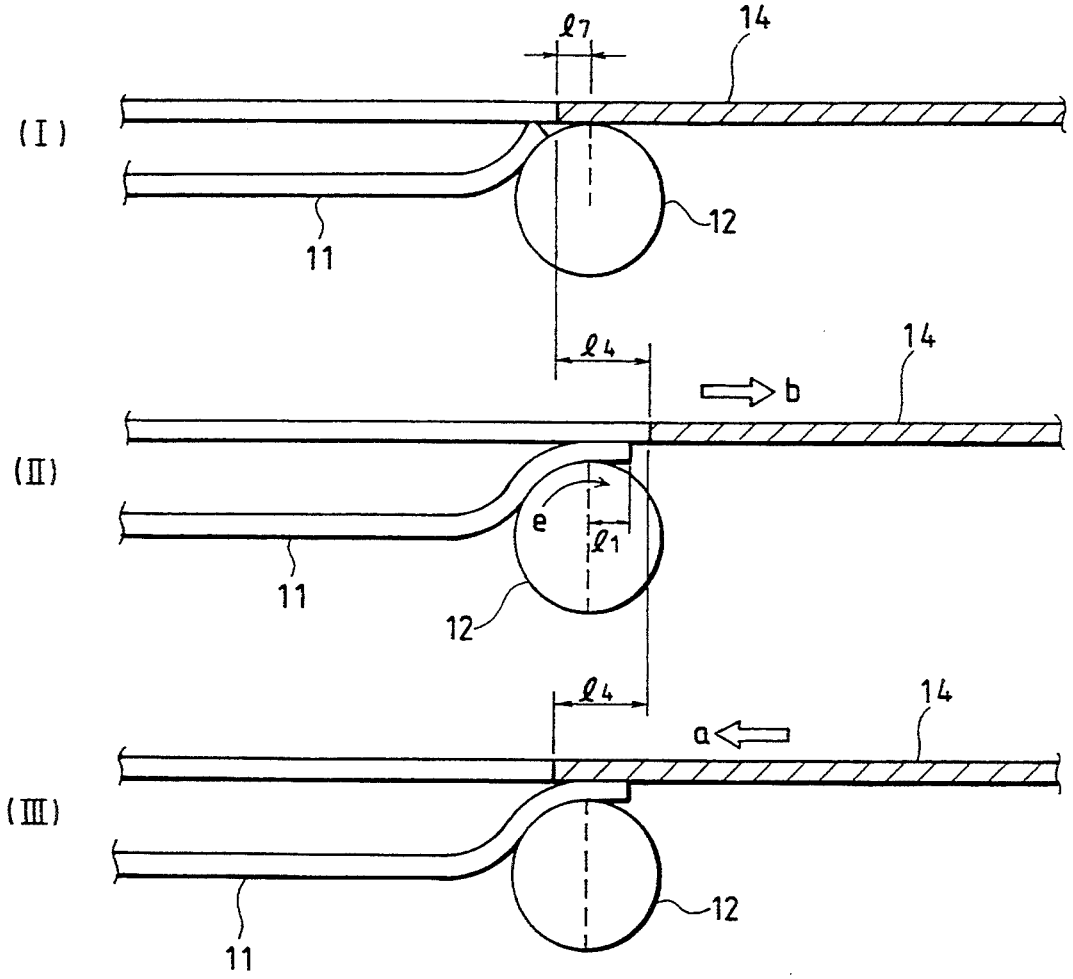

FIG. 5A(I) shows initial positions of both the recording sheet 11 with the oblique orientation corrected, and the ink sheet 14.

Next, the operation proceeds to step S4 where the pickup roller 7 is further rotated in the direction as indicated by arrow h (FIG. 3), and the platen roller 12 is rotated in the direction as indicated by arrow e by the motor for conveying recording sheet 24. At the same time, the ink sheet 14 is conveyed in the direction as indicated by arrow b, driven by the motor for rewinding 38 and the motor for conveying ink sheet 25. As the ink sheet take-up roll 18 can freely rotate in the direction for rewinding the ink sheet with action of the sliding clutch 18*b*, as previously described, the ink sheet 14 is conveyed in the direction as indicated by arrow b. In this way, the recording sheet 11 and the ink sheet 14 are conveyed in the same direction (b and c directions) and at the same speed.

Thereafter, if the leading edge of the recording sheet 11 has been further transferred by a predetermined amount 11 from a recording position of the thermal head 13 in order to position a start line of the recording sheet 11, the operation for conveying the recording sheet 11 is terminated. Assume the total length of ink sheet 14 conveyed at step S4 to be $l_4$. This state is shown in FIG. 5A (II).

At step S5, as shown in FIG. 5A (III), the ink sheet 14 is conveyed slidingly with the recording sheet 11 by a predetermined value in the direction as indicated by arrow a, and is wound onto the take-up roll 18, by driving the motor for conveying ink sheet 25 and the motor for winding ink sheet 41, while the recording sheet 11 is fixed thereon with the platen roller 12 with the drive of the motor for conveying recording sheet 24. This length of ink sheet to be rewound corresponds to the length 14 as above mentioned. As the sliding clutch 18*b* is provided at the rotation axis 18*a* of the take-up roll 18, as previously described, the ink sheet 14 can be wound by rotation of the motor for winding ink sheet 41 without slack. On the other hand, as the sliding clutch 17*b* is attached at the rotation axis 17*a* of the ink sheet supply roll 17, the ink sheet supply roll 17 can draw out the ink sheet 14 by rotating in the arrow direction so as to react to winding of the ink sheet 14, without reversely driving the motor for rewinding ink sheet 38.

At step S6, one line of image data is transferred to the thermal head 13, and recorded by conducting electricity to the thermal head 13. At this time, the heating elements 132 of the thermal head 13 are driven by conduction for each block. Thus if one line of an image has been recorded, the ink sheet 14 is conveyed by (l/n) line in arrow a direction, by driving the motor for conveying ink sheet 25 and the motor for winding ink sheet 41. And the recording sheet 11 is conveyed by one line in arrow c direction, by driving the motor for conveying recording sheet 24. Here there is a relation $V_P = -nV_I$, where $V_P$ is a speed for conveying the recording sheet 11 and $V_I$ is that for conveying the ink sheet 14. It should be noted that one line corresponds to the length of one dot which is recorded by the thermal head 13, and "−" means that the directions for conveying the ink sheet 14 and the recording sheet 11 are opposite to each other.

And at step S7, a determination is made whether or not one page of image recording process has been terminated, and if not, the processing returns to step S6 to repeat the previously described image recording process.

If one page of image recording process is terminated, the operation proceeds to step S8 to check to see if the length of recorded image in the sub-scanning direction corresponds to the length of the recording sheet 11 in the sub-scanning direction, i.e., if the image having the length corresponding to one page of recording sheet 11 has been recorded. This detection can be performed by for example the recording sheet sensor 22 which serves to detect the recording sheet 11. In other words, if the recording sheet 11 is detected by the recording sheet sensor 22, it indicates that a full one page of recording sheet 11 has been not recorded, with latter half portion of recording sheet 11 left blank.

On the other hand, when the recording sheet 11 is not detected by the recording sheet sensor 22, the recording terminated position for the recording sheet 11 can be detected by storing how many lines of the recording sheet 11 were conveyed since the recording sheet sensor 22 had not detected the recording sheet 11, so that a residual quantity of the recording sheet 11 can be determined. For example, assuming a distance from the recording sheet sensor 22 to the recording position with the thermal head 13 to be $l_5$, the distance for which the recording sheet 11 is conveyed since the recording sheet sensor 22 detects a trailing edge of the recording sheet to be $l_p$, and the longitudinal length of blank portion where the trailing portion of the recording sheet 11 has not been recorded to be $l_2$, a full one page of recording sheet 11 is not recorded if $l_5 - l_P > l_2$, which shows that the blank portion exists; and if $l_5 - l_P \leqq l_2$, it can be determined that the recording sheet 11 has been recorded with almost no blank portion (over the full effective recording length).

Figure 5B:
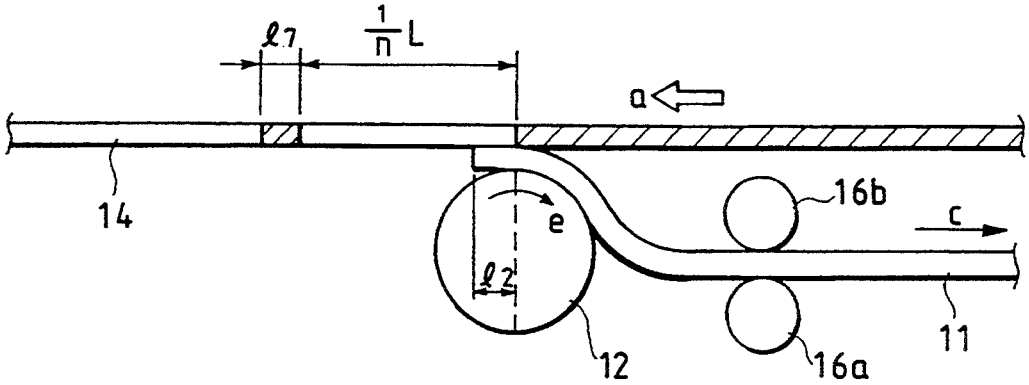

If the length of recorded image data in the sub-scanning direction is equal to the length L of the recording sheet 11 in the sub-scanning direction (or the effective recording length excluding the blanks of $l_1$ and $l_2$ at the leading and trailing edges), the state of the recording sheet 11 and the ink sheet 14 after the recording has terminated is as shown in FIG. 5B, wherein as the ink sheet 14 is conveyed by l/n of the recording sheet 11, the used length of ink sheet in recording is L/n. In this case, control is passed from step S8 to step S10 in FIG. 4.

Figure 5C:
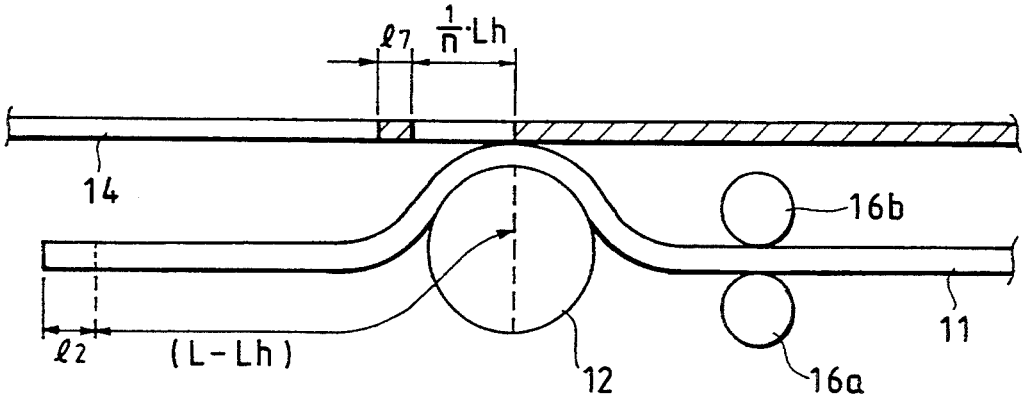
Figure 5D:
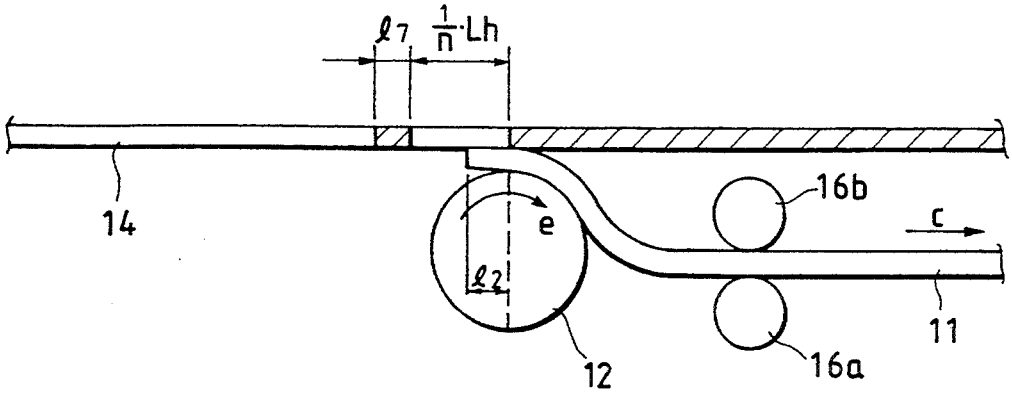

However, as shown in FIG. 5C, when the length of image recorded onto the recording sheet 11 is $L_n$ which is shorter than L, at the termination of recording, the used length of ink sheet 14 is $L_n/n$, while the recording sheet 11 has the length $\{(L-L_n)+l_2\}$ left behind a recording position with the thermal head 13. In this case, proceeding from step S8 to step S9, the ink sheet 14 is stopped and the recording sheet 11 is conveyed in the arrow c direction. And as shown in FIG. 5D, if the recording sheet 11 is conveyed to a position with the length $l_2$ of the recording sheet trailing portion being left behind, the processing proceeds from step S8 to step S10.

Thereby the length $(L-L_n)$ of the ink sheet 14 can be saved, which was conventionally conveyed together with the recording sheet 11. Further, the recording time for one page can be shortened by increasing such conveying speed of the recording sheet 11 during above indicated operation faster than that of the recording sheet 11 during recording.

By the way, as above described, if the ink sheet 14 is stopped and only the recording sheet 11 is conveyed, the recording sheet 11 which is an ordinary one-time sheet becomes dirty as a result that the recording sheet 11 and the ink sheet 14 are rubbed, which required that the thermal head 13 be left away from the platen roller 12 (or placed in a head-up state). However, as the multi print method is designed so that the ink sheet 14 and the recording sheet 11 are conveyed during recording with a relative speed, the ink sheet in the multi print does not become dirty simply because the recording sheet 11 and the ink sheet 14 are rubbed, as described later, which resulted in an advantage that the pressure against the platen roller 12 of the thermal head 13 did not have to be released when only the recording sheet 11 was conveyed.

Figure 5E:
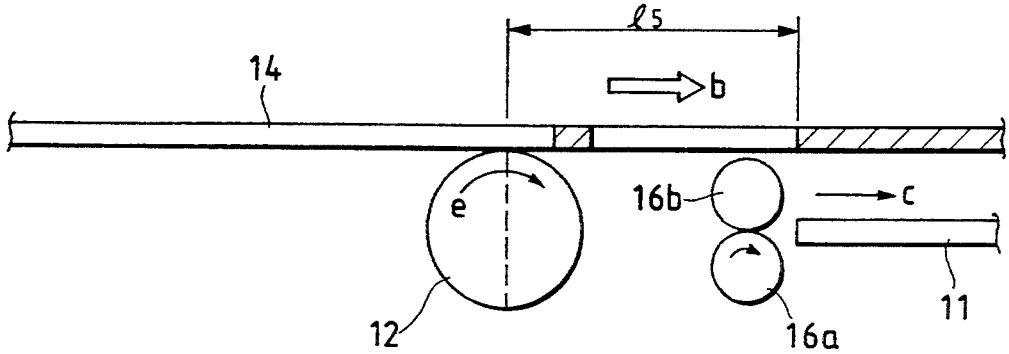

At step S10, the recording sheet 11 and the ink sheet 14 are conveyed by a distance 15 in the same direction and at the same speed, in order to discharge the recorded sheet 11. The state in which they are conveyed in this way is shown in FIG. 5E. Thereby, the recording sheet 11 with images printed is discharged to the tray 9 via the discharge rollers **16*a*, 16*b***.

Figure 5F:
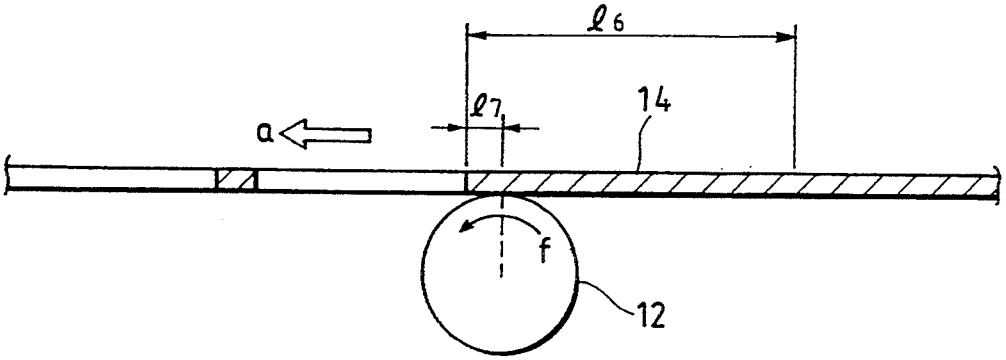

Then proceeding to step S11, by rotating the platen roller 12 in the arrow f direction, the ink sheet 14 is conveyed by a distance $l_6$ at the same peripheral speed as that of the platen roller 12. This state is shown in FIG. 5F. Here there is a relation $l_6 = l_5 + l_7$, where $l_7$ is a distance to be provided for allowance at an initial position of ink sheet 14 so that a part of ink sheet used in previous page may not be positioned at recording location of next page. Then proceeding to step S12, a determination is made whether or not the next page should be recorded, and if so, the processing returns to step S1, and repeats previous operations. And if the image recording of next page is not performed, the record processing of image is terminated.

When both the motor for conveying recording sheet 24 and the motor for conveying ink sheet 25 are constructed with stepping motors, a ratio n of travel speed of the recording sheet 11 to that of the ink sheet 14, as previously described, can be set by selecting the least step angles of those motors to be different from each other. In this way, the relative speed between the recording sheet 11 and the ink sheet 14 can be set to $(1+1/n)V_P$.

Figure 6:
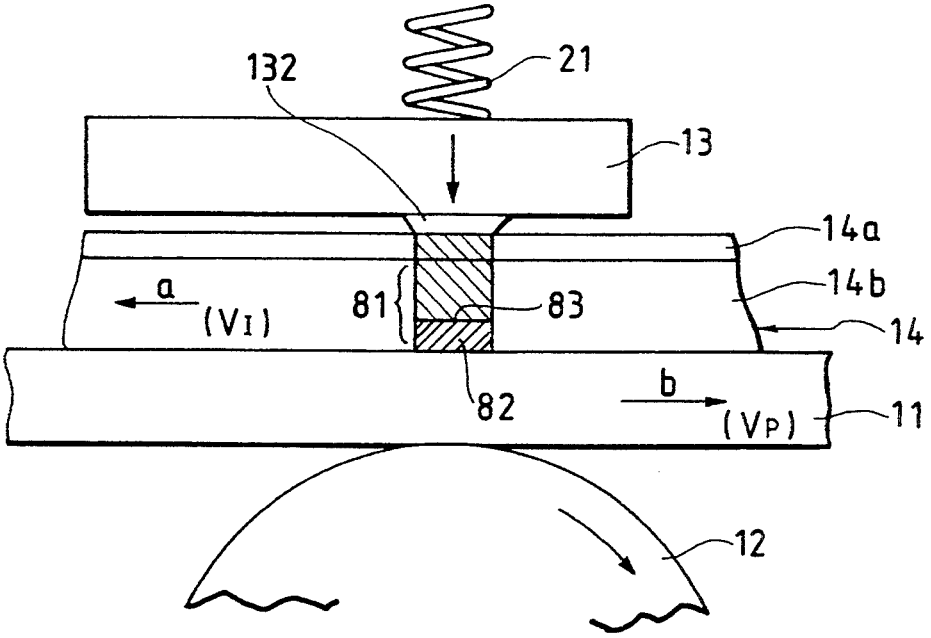
FIG. 6 is a view for illustrating a state between a recording sheet and an ink sheet at the recording according to this invention.

Explanation of recording principal (FIG. 6)

FIG. 6 is a view showing the state in which images are recorded in this example, with the directions for conveying the recording sheet 11 and the ink sheet 14 being opposite.

As seen in the FIG. 6, the recording sheet 11 and the ink sheet 14 are carried between the platen roller 12 and the thermal head 13, with the thermal head 13 being pressed against the platen roller 12 at a predetermined pressure by means of a spring 21. Here the recording sheet 11 is conveyed in the arrow b direction at the speed $V_P$ by rotations of the platen roller 12. On the other hand, the ink sheet 14 is conveyed in the arrow a direction at the speed $V_I$ by rotation of the motor for conveying ink sheet 25.

Now, if the heating resistive elements 132 of the thermal head 13 are heated by conducting electricity from the voltage source unit 105, a slanting line portion 81 of the ink sheet 14 is heated. 14*a* is a base film of the ink sheet 14, and 14*b* is an ink layer of the ink sheet 14. Ink in the ink layer 81 heated by conducting electricity to the heating resistive elements 132 becomes fused, with a part thereof as indicated at 82 being transferred to the recording sheet 11. The ink layer portion 82 to be transferred corresponds to almost 1/n of the ink layer as indicated at 81.

At such an ink transfer operation, it is necessary to transfer only the ink layer portion as indicated at 82 to the recording sheet 11 by applying a shear force against ink at a boundary line 83 with the ink layer 14*b*. However, this shear force depends on the temperature of the ink layer, and the higher the temperature of the ink layer is, the smaller the shear force tends to become. As the shear force within the ink layer increases if the period of heating the ink sheet 14 is decreased, the ink layer to be transferred can be surely peeled off from the ink sheet 14 by increasing a relative speed between the ink sheet 14 and the recording sheet 11.

In this example, as the heating time of the thermal head 13 in the facsimile terminal equipment is short such as about 0.6 ms, the relative speed between the ink sheet 14 and the recording sheet 11 is increased if the directions of conveying the ink sheet 14 and the recording sheet 11 are reversed (opposite).

Figure 7:
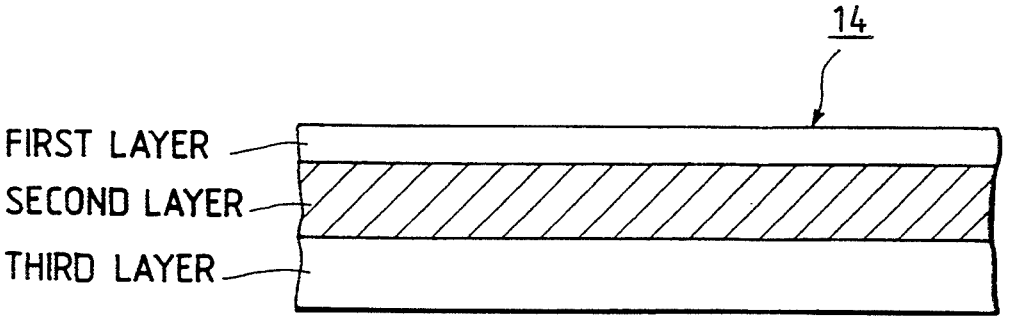
FIG. 7 is a cross-sectional view of an ink sheet used in this invention.

Explanation of ink sheet (FIG. 7)

FIG. 7 shows a cross-sectional view of an ink sheet used for the multi print according to this invention, consisting of three layers in the example.

The second layer is a base film serving as a carrier for the ink sheet 14. In the multi print, as heat energy is applied to the same place as many times, it is advantageous to use a highly heat resistant aromatic polyamide film or condenser paper, but a conventional polyester film can be used as well. The thickness is preferably thinner from the viewpoint of print quality in medium, but 3–8 μm is preferred from the standpoint of strength.

The third layer is an ink layer containing a sufficient amount of ink to allow n times of transfers onto the recording sheet. This component has blended as main components a resin such as EVA for adhesive, a carbon black or nigrosine dye for coloring, and a carnauba wax or paraffin wax for binding material, so as to withstand n multiple uses at the same location. As the ink contained in the third layer is liable to make a recording surface dirty by rubbing with the recording sheet 11, the multi ink sheet according to this invention is constructed so that it may not be transferred onto the recording sheet 11 as long as the temperature of the ink layer is not higher than a certain temperature, with the pressure of about 3–5 kg. The amount of application is preferably 4–8 g/m$^2$ but may be selected as desired, as the sensitiveness and density depend on the amount of application.

The first layer is a heat resistant coated layer for protecting the base film of second layer from the heating of the thermal head 13. This is preferred for the multi print which has a possibility that the amount of heat energy as much as n lines may be applied to the same place (when black data are consecutive), but may or may not be used as appropriate. It is effective for the base film having a relatively low heat resistance such as a polyester film.

It should be noted that the heating method is not limited to the thermal head method using a previous mentioned thermal head, but may use a electric conduction method or laser transfer method.

The recording medium is not limited to a recording sheet, but may be any of the ink transferable materials, such as cloth, plastic sheet and the like. And the ink sheet is not limited to a roll construction as shown in the example, but may be so called an ink sheet cassette type which is removably attached to the body of recording unit, for example, by containing an ink sheet within an enclosure removably attached to the body of recording unit.

The thermal transfer material used in this invention has an ink layer having a binder and a coloring material blended as a carrier, where the binder used in the ink layer is, for example, wax such as carnauba wax, paraffin wax, sozal wax, micro-crystalline wax, and castor wax, higher fatty acid or its metallic salt such as stearic acid, palmitic acid, lauric acid, alminum stearate, and lead stearate, derivatives of ester, or a blend of one or two types of conventional known resins from polyamide resin, polyester resin, epoxy resin, polyurethane resin, or acrylic resin. Further, the coloring material is a blend of one or two types of conventional known coloring materials from, for example, carbon black, nigrosine dye, lampblack, sudan black SM, fast yellow G, benzine yellow, pigment yellow, indo fast orange, and irgadin red. The thickness of ink layer is preferably 1–25 μm, and more preferably 3–15 μm. It should be noted that if the thickness of ink layer is less than 1 μm, a sufficient recording density may not be achieved with the double density recording, and if it exceeds 25 μm, exfoliations from a carrier may occur, or the recording energy must be undesirably increased.

As explained above, according to this example, if the length of image data to be recorded in the sub-scanning direction is shorter than that of a recording sheet in the sub-scanning direction, an ink sheet is stopped and an unrecorded portion of the recording sheet is conveyed, so as to discharge the recorded sheet, after termination of recording of the image data. Thereby the effect can be obtained that the waste of ink sheet is eliminated and the recording time can be shortened.

The recording time can be also further shortened by increasing the speed of conveying the recording sheet when this recording sheet is discharged above that of conveying the recording sheet when it is recorded.

This example was explained by using a full-line type of recording apparatus, but is not limited to such a type, and is also applicable to a serial type of recording apparatus.

In the example as described previously, a case where a thermal transfer recording apparatus was applied to a facsimile terminal equipment was explained, but this invention is not limited to it, and the thermal transfer recording apparatus according to this invention is also applicable to a word processor, a typewriter or a copying machine.

This example was explained by using a multi ink sheet, but this invention is not limited to it, and is also applicable to an ordinary one time sheet as well, with an exception that when only the ink sheet or recording sheet is conveyed, the pressure against the platen roller 12 with the thermal head 13 must be released.

As explained above, according to the invention, the effect can be obtained that if the recording length of image data in the sub-scanning direction is shorter than that of a recording medium in the sub-scanning direction in recording onto the recording medium, the waste of ink sheet can be eliminated and the recording can be performed in a shorter time, by stopping the ink sheet and conveying the recording medium in the discharge direction when discharging the recorded sheet.

According to this invention, the effect can be also obtained that the recording time can be shortened by conveying a recording medium at a higher speed when discharging the recorded sheet than that when recording.

What is claimed is:

1. A method for conveying an ink sheet and a cut sheet in a thermal transfer recording apparatus for transferring an ink contained in the ink sheet onto the cut sheet to record images on the cut sheet by conveying the cut sheet and the ink sheet superposed on each other to a recording position between a thermal head and a platen roller, said cut sheet being provided with a leading portion and having a non-recording area in the leading portion and in an end portion thereof, said method comprising:

a first conveying step of conveying said cut sheet in a first direction whereby a leading edge of said cut sheet contacts the platen roller in order to prevent said cut sheet from being obliquely conveyed;

a second conveying step of conveying said cut sheet in said first direction by a length corresponding to a length of the non-recording area in said first direction in order to position the non-recording area provided in the leading portion of said cut sheet, at nearer position in said first direction than said recording position;

a third conveying step of conveying each of said ink sheet and said cut sheet in order to perform thermal transfer recording;

a fourth conveying step of ceasing to convey said ink sheet, and conveying said cut sheet in said first direction so that the non-recording area of the end portion of said cut sheet is positioned adjacent to said recording position, when a recording length of said cut sheet in said first direction is shorter than an available recording length of said cut sheet in said first direction;

a fifth conveying step of conveying said ink sheet and said cut sheet in said first direction in order to discharge said cut sheet from said recording position; and a sixth conveying step of conveying said ink sheet in a second direction opposed to said first direction so that the leading portion of the non-recording area of said ink sheet is positioned adjacent to said recording position in order to return said ink sheet to a predetermined position.

2. A method according to claim 1, wherein a conveying speed at which said cut sheet is conveyed so that the non-recording area of the end portion of said cut sheet is positioned adjacent to said recording position is faster than a conveying speed during recording.

3. A method according to claim 1, further comprising the steps of:

discharging said cut sheet after termination of recording by conveying said cut sheet and said ink sheet together in said first direction, and, thereafter, repositioning said ink sheet by rewinding said ink sheet in said second direction by a predetermined amount.

4. A method according to claim 1, wherein when recording, said ink sheet and said cut sheet are conveyed in opposite directions.

5. A method according to claim 1, wherein when recording, said ink sheet is conveyed by a first amount and said cut sheet is conveyed by a second amount, said first amount being less than said second amount.

6. A method according to claim 1, wherein at least in said fourth conveying step the cut sheet is conveyed in a state such that the thermal head and the platen roller press together the cut sheet and the ink sheet.

7. A thermal transfer recording apparatus for transferring an ink contained in an ink sheet onto a cut sheet to record images on the recording sheet by conveying the cut sheet and the ink sheet superposed on each other to a recording position between a thermal head and a platen roller, said cut sheet being provided with a non-recording area in a leading portion and in an end portion thereof, said apparatus comprising:

a first conveying means for conveying said ink sheet;

a second conveying means for conveying said cut sheet;

a determining portion for determining whether a recording length of said cut sheet in a first direction is shorter than an available recording length of said cut sheet in said first direction; and a controlling means for controlling said first and said second conveying mechanisms, said controlling means operating by effecting sequentially the steps of:

(a) effecting conveyance of said cut sheet by said second conveying means in said first direction whereby a leading edge of said cut sheet contacts the platen roller in order to prevent said cut sheet from being obliquely conveyed;

(b) effecting conveyance of said cut sheet by said second conveying means in said first direction by a length corresponding to a length of the non-recording area in said first direction in order to position the non-recording area provided in the leading portion of said cut sheet, at a nearer position in said first direction than said recording position;

(c) effecting conveyance of each of said ink sheet and said cut sheet by said first and said second conveying means, respectively, in order to perform thermal transfer recording;

(d) ceasing conveyance of said ink sheet by said first conveying means, and effecting conveyance of said cut sheet by said second conveying means in said first direction so that the non-recording area of the end portion of said cut sheet is positioned adjacent to said recording position, when a determining result of said determining portion is that a recording length of said cut sheet in said first direction is shorter than the available recording length of said cut sheet in said first direction;

(e) effecting conveyance of each of said ink sheet and said cut sheet by said first and said second conveying means, respectively, in said first direction in order to discharge said cut sheet from said recording position;

(f) effecting conveyance of said ink sheet by said first conveying means in a second direction opposed to said first direction so that the leading portion of the non-recording area of said ink sheet is positioned adjacent to said recording position in order to return said ink sheet to a predetermined position; and repositioning means for repositioning said ink sheet so that when said cut sheet is discharged after termination of recording, said ink sheet and said cut sheet are conveyed together in said first direction, and thereafter said ink sheet is rewound in said second direction by a predetermined amount.

8. An apparatus according to claim 7, wherein when at least said (d) ceasing to convey step is effected, the cut sheet is conveyed in a state such that the thermal head and the platen roller press together the cut sheet and the ink sheet.

9. A thermal transfer recording apparatus for recording images onto a recording medium by transferring an ink contained in an ink sheet onto the recording medium, said apparatus comprising:

ink sheet conveying means for conveying the ink sheet;

recording medium conveying means for conveying the recording medium, the recording medium having an effective recording length;

recording means for recording images at a recording position onto the recording medium by acting upon the ink sheet;

discriminating means for discriminating if a length of images recorded onto the recording medium is not more than the effective recording length of the recording medium; and control means for controlling conveyance of the recording medium and the ink sheet so that the ink sheet will be stopped and a trailing end portion of the recording medium will be located at the recording position of the recording means, in order to prepare for discharge of the recording medium if the discriminating means discriminates that the length of images recorded is less than the effective recording length.

10. An apparatus according to claim 9, wherein said recording medium comprises a cut sheet.

11. An apparatus according to claim 9, wherein when conveyance of the ink sheet is stopped and only the recording medium is conveyed, the recording medium is conveyed at a speed higher than a conveyance speed of the recording medium during image recording.

12. A thermal transfer recording method for recording images onto a recording medium by transferring an ink contained in an ink sheet onto the recording medium, said method comprising the steps of:

discriminating if a length of images recorded onto the recording medium is not more than an effective recording length of the recording medium; and controlling conveyance of the ink sheet and recording medium by stopping the ink sheet and conveying the recording medium so that a trailing end portion of the recording medium will be located at a recording position of a recording means, in order to prepare for discharge of the recording medium if in said discriminating step it is discriminated that the length of images recorded is less than the effective recording length of the recording medium.

13. A method according to claim 12, wherein said recording medium comprises a cut sheet.

14. A method according to claim 12, wherein when conveyance of the ink sheet is stopped and only the recording medium is conveyed, the recording medium is conveyed at a speed higher than a conveyance speed of the recording medium during image recording.

* * * * *

UNITED STATES PATENT AND TRADEMARK OFFICE

CERTIFICATE OF CORRECTION

PATENT NO. : 5,450,100

DATED : September 12, 1995

INVENTOR(S) : MASAKATSU YAMADA, ET AL.

It is certified that error appears in the above-identified patent and that said Letters Patent is hereby corrected as shown below:

ON TITLE PAGE

In [56] References Cited, under FOREIGN PATENT DOCUMENTS:
"0298473" should read --2-98473-- and
"2206574" should read --2-206574--.

COLUMN 1

Line 41, "above mentioned" should read --above-mentioned--.
Line 44, "(so called a" should read --(a so-called--.

COLUMN 2

Line 8, "it" should read --is--.
Line 45, "at the" should read --during--.

COLUMN 4

Line 15, "rotations" should read --rotation--.
Line 19, "arrow." should read --arrow b.--.
Line 28, "a" should be deleted.
Line 33, "rotations" should read --rotation--.
Line 35, "roller" should read --roll--.
Line 60, "counter-clockwise." should read --counterclockwise.--.
Line 64, "multi ink" should read --multi-ink--.
Line 66, "roller" should read --roller 12--.

COLUMN 6

Line 20, "pressed" should read --is pressed--.
Line 42, "amount 11" should read --amount $l_1$--.
Line 56, "length 14" should read --length $l_4$--.

UNITED STATES PATENT AND TRADEMARK OFFICE

CERTIFICATE OF CORRECTION

PATENT NO. : 5,450,100

DATED : September 12, 1995

INVENTOR(S) : MASAKATSU YAMADA, ET AL.

It is certified that error appears in the above-identified patent and that said Letters Patent is hereby corrected as shown below:

COLUMN 8

Line 24, "multi" should read --multi- --.
Line 27, "multi print" should read --multi-print--.
Line 35, "distance 15" should read --distance $l_5$--.

COLUMN 9

Line 7, "rotations" should read --rotation--.
Line 42, "multi print" should read --multi-print--.
Line 45, "multi print," should read --multi-print,--.
Line 46, "as" should be deleted.
Line 61, "multi ink" should read --multi-ink--.

COLUMN 10

Line 4, "multi print" should read --multi-print--.
Line 12, "a" should read --an--.
Line 18, "so called an" should read --a so-called--.
Line 27, "micro-crystalline" should read --microcrystalline--.
Line 29, "alminum" should read --aluminum--.

COLUMN 11

Line 1, "multi ink" should read --multi-ink--.
Line 3, "one time" should read --one-time--.
Line 41, "nearer" should read --a nearer--.

UNITED STATES PATENT AND TRADEMARK OFFICE

CERTIFICATE OF CORRECTION

PATENT NO. : 5,450,100

DATED : September 12, 1995

INVENTOR(S) : MASAKATSU YAMADA, ET AL.

It is certified that error appears in the above-identified patent and that said Letters Patent is hereby corrected as shown below:

COLUMN 12

Line 36, "mechanisms," should read --means,--.

Signed and Sealed this

Fifth Day of March, 1996

Bruce Lehman

*Attest:*

BRUCE LEHMAN

*Attesting Officer*

*Commissioner of Patents and Trademarks*